US006092675A

United States Patent [19]

Ramirez, Jr. et al.

[11] Patent Number: 6,092,675

[45] Date of Patent: Jul. 25, 2000

[54] POOL CUE HOLDER ATTACHMENT

[76] Inventors: Domingo Y. Ramirez, Jr., 10079 Birch Field; Maria E. Ramirez, 2422 Mud Lake, both of San Antonio, Tex. 78245

[21] Appl. No.: 09/133,442

[22] Filed: Aug. 13, 1998

[51] Int. Cl.[7] ..... A47F 7/00

[52] U.S. Cl. ..... 211/68; 211/60.1; 211/89.01; 473/15; 473/50; 473/44

[58] Field of Search ..... 211/68, 60.1, 63, 211/89.01, 70.6, 85, 71.01, 84, 104, 2, 4, 41.15; 473/15, 19, 21, 39, 42, 44, 50, 46, 43

[56] References Cited

U.S. PATENT DOCUMENTS

| | | | |
|---|---|---|---|
| 658,042 | 9/1900 | Mendel | 211/68 X |
| 1,478,032 | 12/1923 | Hine | 211/68 X |
| 1,661,121 | 2/1928 | Huson | 211/70.6 X |
| 1,719,360 | 7/1929 | Deike | 211/68 X |
| 2,222,831 | 11/1940 | Bitney | 211/63 X |
| 2,408,227 | 9/1946 | Ramsey | 211/70.6 X |
| 2,499,159 | 2/1950 | Pestyner | 211/104 X |
| 2,515,293 | 7/1950 | Carter | 211/104 X |
| 3,217,891 | 11/1965 | Weaver | 211/63 X |
| 3,752,342 | 8/1973 | Stevens et al. | 211/63 X |
| 4,305,629 | 12/1981 | Friis | 211/70.6 X |
| 4,509,648 | 4/1985 | Govang et al. | 211/70.6 |
| 4,511,040 | 4/1985 | Tolentino | 211/70.6 X |
| 5,005,710 | 4/1991 | Hofer | 211/70.6 |
| 5,224,602 | 7/1993 | Bettles et al. | 211/60.1 X |

*Primary Examiner*—Daniel P. Stodola
*Assistant Examiner*—Khoa Tran

[57] ABSTRACT

A pool cue holder attachment for holding pool cues to the side of a table. Included is a base block having a plurality of spaced apart bores extending between the top and bottom sides of the base block. The base block also has a plurality slots with each slot extending between the front side of the base block and an associated bore of the base block. A cover member for covering the ends and sides of the base block. A pair of clamp members are coupled to the cover member, the clamp members is adapted for detachable attachment to a side of a table.

8 Claims, 2 Drawing Sheets

POOL CUE HOLDER ATTACHMENT

BACKGROUND OF THE INVENTION

1. Field of the Invention

The present invention relates to accessories for billiard games and more particularly pertains to a new pool cue holder attachment for holding pool cues to the side of a table.

2. Description of the Prior Art

The use of accessories for billiard games is known in the prior art. More specifically, accessories for billiard games heretofore devised and utilized are known to consist basically of familiar, expected and obvious structural configurations, notwithstanding the myriad of designs encompassed by the crowded prior art which have been developed for the fulfillment of countless objectives and requirements.

Known prior art accessories for billiard games include U.S. Pat. No. 5,255,799; U.S. Pat. No. 4,903,929; U.S. Pat. No. 5,139,221; U.S. Pat. No. 5,338,261; U.S. Pat. No. 3,603,551; and U.S. Pat. No. Des. 303,192.

While these devices fulfill their respective, particular objectives and requirements, the aforementioned patents do not disclose a new pool cue holder attachment. The inventive device includes a base block having a plurality of spaced apart bores extending between the top and bottom sides of the base block. The base block also has a plurality slots with each slot extending between the front side of the base block and an associated bore of the base block. A cover member for covering the ends and sides of the base block. A pair of clamp members are coupled to the cover member, the clamp members is adapted for detachable attachment to a side of a table.

In these respects, the pool cue holder attachment according to the present invention substantially departs from the conventional concepts and designs of the prior art, and in so doing provides an apparatus primarily developed for the purpose of holding pool cues to the side of a table.

SUMMARY OF THE INVENTION

In view of the foregoing disadvantages inherent in the known types of accessories for billiard games now present in the prior art, the present invention provides a new pool cue holder attachment construction wherein the same can be utilized for holding pool cues to the side of a table.

The general purpose of the present invention, which will be described subsequently in greater detail, is to provide a new pool cue holder attachment apparatus and method which has many of the advantages of the accessories for billiard games mentioned heretofore and many novel features that result in a new pool cue holder attachment which is not anticipated, rendered obvious, suggested, or even implied by any of the prior art accessories for billiard games, either alone or in any combination thereof.

To attain this, the present invention generally comprises a base block having a plurality of spaced apart bores extending between the top and bottom sides of the base block. The base block also has a plurality slots with each slot extending between the front side of the base block and an associated bore of the base block. A cover member for covering the ends and sides of the base block. A pair of clamp members are coupled to the cover member, the clamp members is adapted for detachable attachment to a side of a table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new pool cue holder attachment apparatus and method which has many of the advantages of the accessories for billiard games mentioned heretofore and many novel features that result in a new pool cue holder attachment which is not anticipated, rendered obvious, suggested, or even implied by any of the prior art accessories for billiard games, either alone or in any combination thereof.

It is another object of the present invention to provide a new pool cue holder attachment which may be easily and efficiently manufactured and marketed.

It is a further object of the present invention to provide a new pool cue holder attachment which is of a durable and reliable construction.

An even further object of the present invention is to provide a new pool cue holder attachment which is susceptible of a low cost of manufacture with regard to both materials and labor, and which accordingly is then susceptible of low prices of sale to the consuming public, thereby making such pool cue holder attachment economically available to the buying public.

Still yet another object of the present invention is to provide a new pool cue holder attachment which provides in the apparatuses and methods of the prior art some of the advantages thereof, while simultaneously overcoming some of the disadvantages normally associated therewith.

Still another object of the present invention is to provide a new pool cue holder attachment for holding pool cues to the side of a table.

Yet another object of the present invention is to provide a new pool cue holder attachment which includes a base block having a plurality of spaced apart bores extending between the top and bottom sides of the base block. The base block also has a plurality slots with each slot extending between the front side of the base block and an associated bore of the base block. A cover member for covering the ends and sides of the base block. A pair of clamp members are coupled to the cover member, the clamp members is adapted for detachable attachment to a side of a table.

Many pool halls only offer cue holders for their own pool cues and typically, these holders are attached to one of the walls of the pool hall some distance from the table a user is playing on. Still yet another object of the present invention is to provide a new pool cue holder attachment that allows users to carry along to a pool hall an holder that is attachable to the side of a table to hold several pool cues.

Even still another object of the present invention is to provide a new pool cue holder attachment that provides pool players with a device that allows them to have their hands free from carrying their pool cue to perform other activities without having to leave their pool cues resting against a wall or a chair and thereby risking damage to the pool cue from falls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
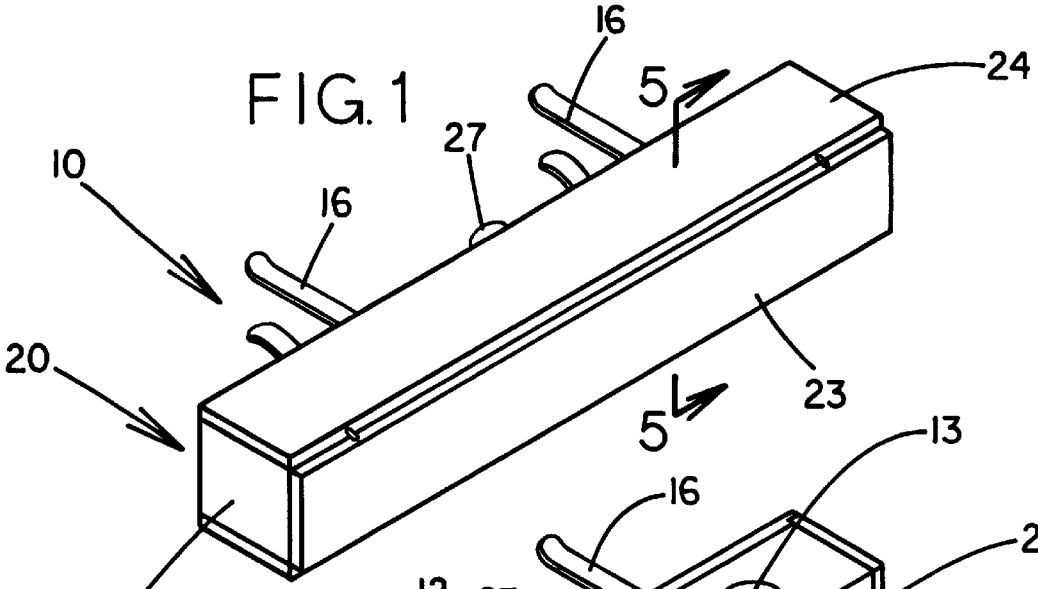
FIG. 1 is a schematic perspective view of a new pool cue holder attachment with the cover member covering the base block according to the present invention.

With reference now to the drawings, and in particular to FIGS. 1 through 5 thereof, a new pool cue holder attachment embodying the principles and concepts of the present invention and generally designated by the reference numeral 10 will be described.

As best illustrated in FIGS. 1 through 5, the pool cue holder attachment 10 generally comprises a base block 12 having a plurality of spaced apart bores 13 extending between the top and bottom sides of the base block 12. The base block 12 also has a plurality slots 14 with each slot extending between the front side of the base block 12 and an associated bore of the base block 12. A cover member 20 for covering the ends and sides of the base block 12. A pair of clamp members 16 are coupled to the cover member 20, the clamp members 16 is adapted for detachable attachment to a side of a table.

In closer, detail, the attachment 10 is designed for holding pool cues to the side of a table. The base block 12 is generally rectangular and has a pair of ends and elongate front, back, top, and bottom sides. The ends and the sides of the base block 12 are generally rectangular in shape. The base block 12 has a length defined between the ends of the base block 12. Preferably, the length of the base block 12 is between about 3 and 18 inches and is ideally about 17½ inches. The base block 12 has a plurality of preferably equidistantly spaced apart bores 13 extending therethrough between the top and bottom sides of the base block 12. Preferably, the bores 13 is generally cylindrical. In use, each of the bores 13 is adapted for receiving a pool cue therein. The base block 12 also has a plurality slots 14. Each slot is extended between the front side of the base block 12 and an associated bore of the base block 12 such that each slot provides an opening in the front side of the base block 12 into the associated bore of the base block 12. Preferably, the slots 14 of the base block 12 lie in planes substantially parallel to one another. The base block 12 preferably comprises a resiliently deformable material such as a foamed rubber so that a pool cue is held to the base block when extended through a bore and so that the pool cue is easily removable from the bore.

The attachment 10 also includes a cover member 20 for covering the ends and sides of the base block 12. The cover member 20 comprises generally rectangular first and second end panels 25,26 and interconnected generally rectangular elongate first, second, third, and fourth side panels 21,22, 23,24. Preferably, the length of each of the side panels is greater than about 3 inches and is ideally about 17½ inches. Preferably the width of each of the side panels is about 2 inches and the thickness of each of the side panels is about ¼ inch.

Figure 2:
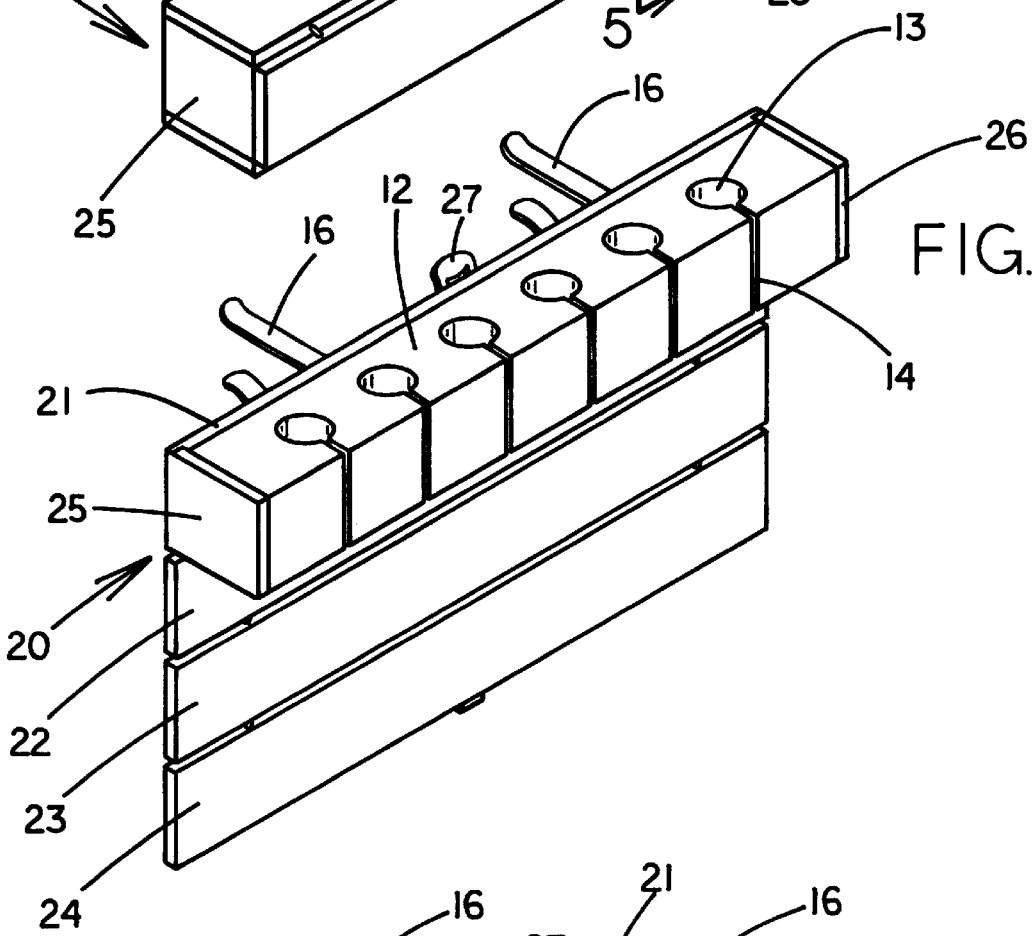
FIG. 2 is a schematic perspective view of the present invention with the base block uncovered.
Figure 3:
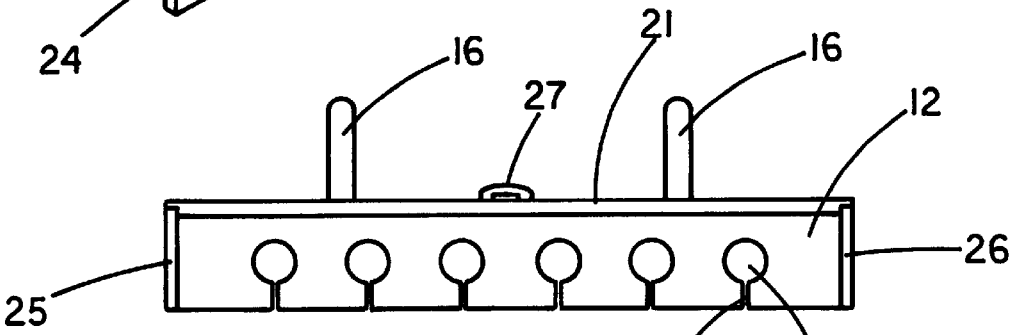
FIG. 3 is a schematic top side view of the present invention.
Figure 4:
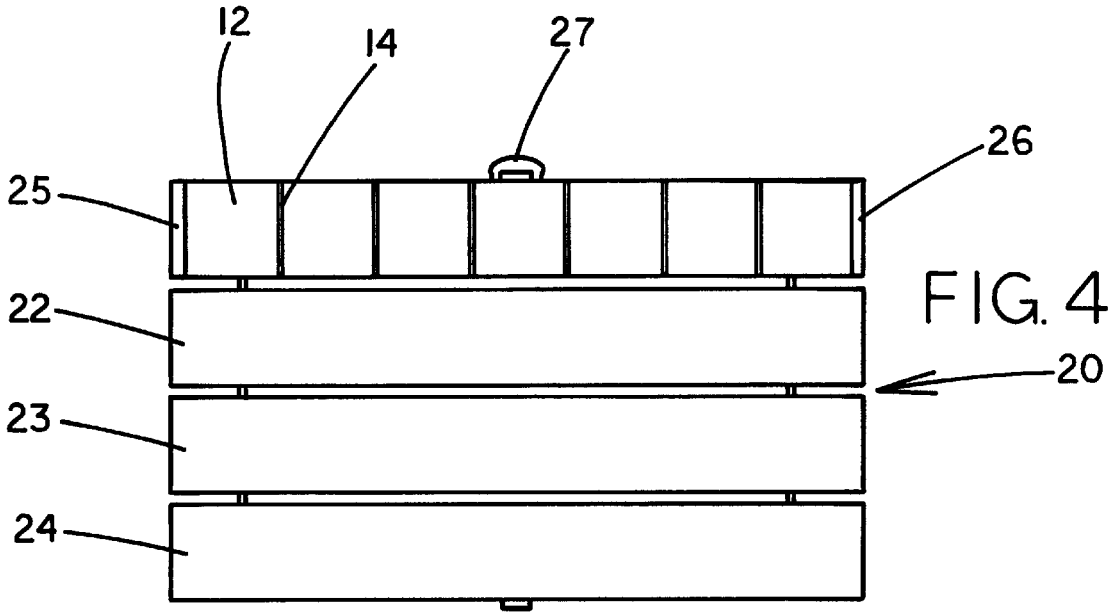
FIG. 4 is a schematic from side view of the present invention.

The first side panel 21 is coupled to the back side of the base block 12 with the length of the first side panel 21 is extended between the ends of the base block 12. The first end panel 25 is coupled to one of the ends of the base block 12 and to the first side panel 21 such that the first end panel 25 substantially covers the one of the ends of the base block 12. Similarly, the second end panel 26 is coupled to another of the ends of the base block 12 and to the first side panel 21 such that the second end panel 26 substantially covers the other of the ends of the base block 12. With reference to FIGS. 2 and 4, the second side panel 22 is hingedly coupled to the first side panel 21 ideally by string hinges. The third side panel 23 is hingedly coupled to the second side panel 22 and the fourth side panel 24 is hingedly coupled to the third side panel 23. This configuration allows the second, third and fourth side panels 22,23,24 to downwardly depend from the first side panel 21 when the side panels are not covering their associated sides of the base block 12.

Figure 5:
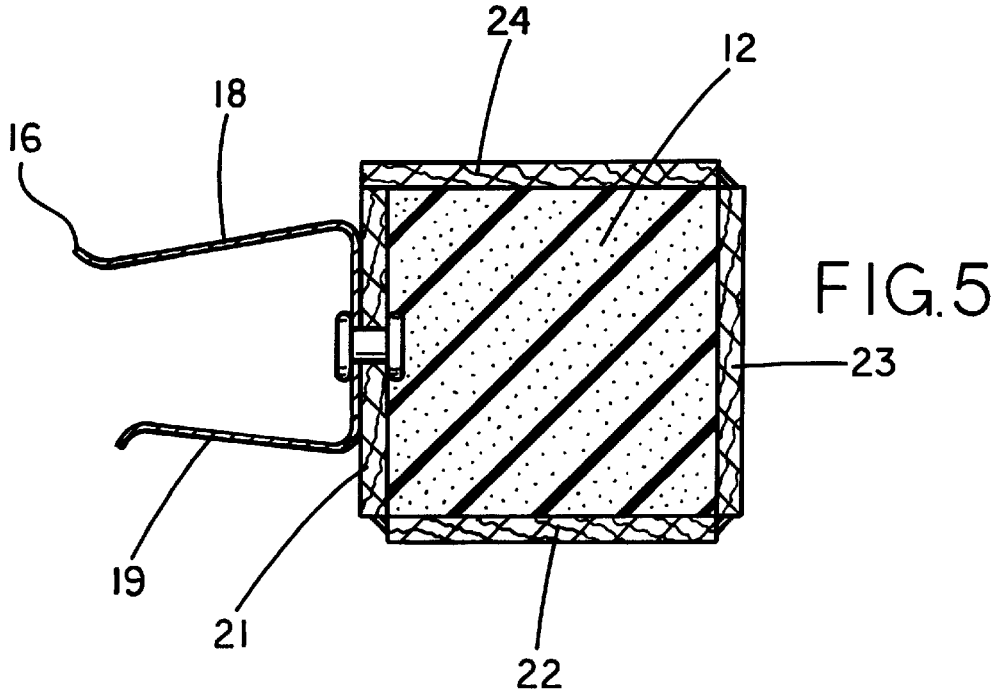
FIG. 5 is a schematic cross sectional view of the present invention as taken by line 5—5 of FIG. 1.

With reference to FIGS. 1 and 5, the second, third, and fourth side panels 22,23,24 are pivotable to substantially cover the bottom, front and top sides of the base block 12. Specifically, the second side panel 22 is positionable adjacent the bottom side of the base block 12 such that the second side panel 22 substantially covers the bottom side of the base block 12. The third side panel 23 is positionable adjacent the front side of the base block 12 to substantially cover the front side of the base block 12 when the second side panel 22 is positioned adjacent the bottom side of the base block 12. Finally, the fourth side panel 24 is positionable adjacent the top side of the base block 12 to substantially cover the top side of the base block 12 when the third side panel 23 is positioned adjacent the front side of the base block 12. Preferably, a latch 27 is provided to releasably couple the fourth side panel 24 to the first side panel 21 when the fourth side panel 24 is positioned on the top side of the base block 12 adjacent the first side panel 21.

As illustrated in FIGS. 1, 2, 3 and 5, a pair of clamp members 16 are coupled to the first side panel 21. The clamp members 16 are adapted for detachable attachment to a side of a table. Preferably, each of the clamp members 16 comprises a pair of spaced apart arms 18,19 adapted for holding a portion of a side of a table therebetween.

In use, the attachment 10 is attached to the side of a table with the clamp members. The side panels of the cover member are unfolded from around the base block to expose the bores of the base block. A user may then insert a pool cue into one of the bores of the base block so that the pool cue is held to the base block. When transporting the attachment, the side panels are folded up over the base block and held in place by the latch. This configuration provides a compact unit for a user to easily carry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in he specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An attachment for holding pool cues to the side of a table, said attachment comprising:

a base block having a pair of ends and elongate front, back, top, and bottom sides;

said base block having a plurality of spaced apart bores extending therethrough between said top and bottom sides of said base block;

said base block having a plurality slots, each slot being extended between said front side of said base block and an associated bore of said base block such that each slot provides an opening in said front side of said base block into the associated bore of said base block;

a cover member for covering said ends and sides of said base block; and a pair of clamp members being coupled to said cover member, said clamp members being adapted for detachable attachment to a side of a table;

wherein said cover member comprises first and second end panels and interconnected elongate first, second, third, and fourth side panels;

said first side panel being coupled to said back side of said base block;

said first end panel being coupled to one of said ends of said base block and to said first side panel such that said first end panel selectively covers the one of said ends of said base block;

said second end panel being coupled to another of said ends of said base block and to said first side panel such that said second end panel selectively covers the other of said ends of said base block; and said second, third, and fourth side panels being pivotable to selectively cover said bottom, front and top sides of said base block.

2. The attachment of claim 1, wherein said second side panel is pivotally coupled to said first side panel, wherein said third side panel is pivotally coupled to said second side panel, wherein said fourth side panel is pivotally coupled to said third side panel.

3. The attachment of claim 2, wherein said second side panel is positionable adjacent said bottom side of said base block such that said second side panel selectively covers said bottom side of said base block, wherein said third side panel is positionable adjacent said front side of said base block to selectively cover said front side of said base block when said second side panel is positioned adjacent said bottom side of said base block, and wherein said fourth side panel is positionable adjacent said top side of said base block to selectively cover said top side of said base block when said third side panel is positioned adjacent said front side of said base block.

4. The attachment of claim 3, further comprising a latch coupling said fourth side panel to said first side panel when said fourth side panel is positioned adjacent said first side panel.

5. The attachment of claim 1, said base block has a length defined between said ends of said base block, said length of said base block being between 3 and 18 inches.

6. The attachment of claim 1, wherein said slots of said base block lie in planes substantially parallel to one another.

7. The attachment of claim 1, wherein said base block comprises a resiliently deformable material.

8. An attachment for holding pool cues to the side of a table, said attachment comprising:

a base block being generally rectangular and having a pair of ends and elongate front, back, top, and bottom sides;

said base block having a length defined between said ends of said base block, said length of said base block being between 3 and 18 inches;

said base block having a plurality of spaced apart bores extending therethrough between said top and bottom sides of said base block, said bores being generally cylindrical;

said base block having a plurality slots, each slot being extended between said front side of said base block and an associated bore of said base block such that each slot provides an opening in said front side of said base block into the associated bore of said base block, said slots of said base block lying in planes substantially parallel to one another;

said base block comprising a resiliently deformable material;

a cover member for covering said ends and sides of said base block, said cover member comprising first and second end panels and elongate first, second, third, and fourth side panels, each of said side panels having a length;

said first side panel being coupled to said back side of said base block, said length of said first side panel being extended between said ends of said base block;

said first end panel being coupled to one of said ends of said base block and to said first side panel such that said first end panel selectively covers the one of said ends of said base block;

said second end panel being coupled to another of said ends of said base block and to said first side panel such that said second end panel selectively covers the other of said ends of said base block;

said second side panel being pivotally coupled to said first side panel;

said third side panel being pivotally coupled to said second side panel;

said fourth side panel being pivotally coupled to said third side panel;

said second, third, and fourth side panels being pivotable to selectively cover said bottom, front and top sides of said base block;

said second side panel being positionable adjacent said bottom side of said base block such that said second side panel selectively covers said bottom side of said base block;

said third side panel being positionable adjacent said front side of said base block to selectively cover said front side of said base block when said second side panel is positioned adjacent said bottom side of said base block;

said fourth side panel being positionable adjacent said top side of said base block to selectively cover said top side of said base block when said third side panel is positioned adjacent said front side of said base block;

a latch coupling said fourth side panel to said first side panel when said fourth side panel is positioned adjacent said first side panel; and a pair of clamp members being coupled to said first side panel, said clamp members being adapted for detachable attachment to a side of a table, wherein each of said clamp members comprises a pair of spaced apart arms adapted for holding a portion of a side of a table therebetween.

* * * * *